United States Patent [19]

Ditman

[11] Patent Number: 4,663,028

[45] Date of Patent: May 5, 1987

[54] PROCESS OF PREPARING A DONOR SOLVENT FOR COAL LIQUEFACTION

[75] Inventor: John G. Ditman, Newark, N.J., by Roger D. Ditman, executor

[73] Assignee: Foster Wheeler USA Corporation, Livingston, N.J.

[21] Appl. No.: 770,082

[22] Filed: Aug. 28, 1985

[51] Int. Cl.[4] ..... C10G 1/00; C10G 1/06; C10G 1/18; C10C 3/00

[52] U.S. Cl. ..... 208/428; 208/430; 208/431; 208/435; 208/45; 208/309

[58] Field of Search ..... 208/8 LE, 10, 45, 309, 208/428, 430, 431, 435

[56] References Cited

U.S. PATENT DOCUMENTS

| | | | |
|---|---|---|---|
| 2,002,004 | 5/1935 | Good | 204/14 |
| 2,101,308 | 12/1937 | Bray et al. | 208/309 |
| 2,914,457 | 11/1959 | Reavon | 208/79 |
| 2,967,818 | 1/1961 | Garwin | 208/45 |
| 2,980,602 | 4/1961 | Garwin | 208/45 |
| 3,003,946 | 10/1961 | Garwin | 208/45 |
| 3,005,769 | 10/1961 | Garwin | 208/45 |
| 3,074,882 | 1/1963 | Gross et al. | 208/309 |
| 3,155,607 | 11/1964 | Friesc | 208/45 X |
| 3,583,900 | 6/1971 | Gatsis | 208/8 LE |
| 3,598,718 | 8/1971 | Gleim et al. | 208/8 LE |
| 3,607,716 | 9/1971 | Roach | 208/10 X |
| 3,830,732 | 8/1974 | Gatsis | 208/309 |
| 3,997,425 | 12/1976 | Gatsis et al. | 208/8 LE |
| 4,081,358 | 3/1978 | Ton et al. | 208/8 LE |
| 4,081,359 | 3/1978 | Gatsis et al. | 208/8 LE |
| 4,081,360 | 3/1978 | Ton et al. | 208/8 LE |
| 4,119,523 | 10/1978 | Baldwin et al. | 208/8 LE |
| 4,164,466 | 8/1979 | Baldwin et al. | 208/8 LE X |
| 4,176,048 | 11/1979 | Corns et al. | 208/309 X |
| 4,239,616 | 12/1980 | Gearhart | 208/45 X |
| 4,259,171 | 3/1981 | Staelhofer et al. | 208/45 |
| 4,312,747 | 1/1982 | Gatsis | 208/8 LE X |
| 4,448,672 | 5/1984 | Angevine et al. | 208/309 X |
| 4,460,454 | 7/1984 | Iijima et al. | 208/45 X |
| 4,476,012 | 10/1984 | Gatsis | 208/8 LE |
| 4,482,453 | 11/1984 | Coombs et al. | 208/309 |
| 4,536,275 | 8/1985 | Bronferbrenner et al. | 208/10 |

FOREIGN PATENT DOCUMENTS

| | | | |
|---|---|---|---|
| 55-116792 | 2/1979 | Japan | 208/45 |

*Primary Examiner*—Carl F. Dees
*Assistant Examiner*—William G. Wright
*Attorney, Agent, or Firm*—Marvin A. Naigur; John E. Wilson; Robert D. Bajefsky

[57] ABSTRACT

A process of preparing a donor solvent for coal liquefaction. Liquefied coal is distilled to separate the coal into a fraction having a boiling point less than about 350° F. and a residue having a boiling point greater than about 350° F. The residue from the distillation is deasphalted in a first solvent capable of substantially extracting from the residue a first oil comprising lower molecular weight compounds and saturated compounds. The residue from the first deasphalting step is then deasphalted in a second solvent capable of substantially extracting from the residue a second oil comprising concentrated aromatic and heterocyclic compounds and leaving in the residue asphaltenes and ash. The second oil can be used as a donor solvent. The second oil extracted in the second deasphalting step is preferably partially hydrogenated prior to use as a donor solvent for the liquefaction of coal.

19 Claims, 1 Drawing Figure

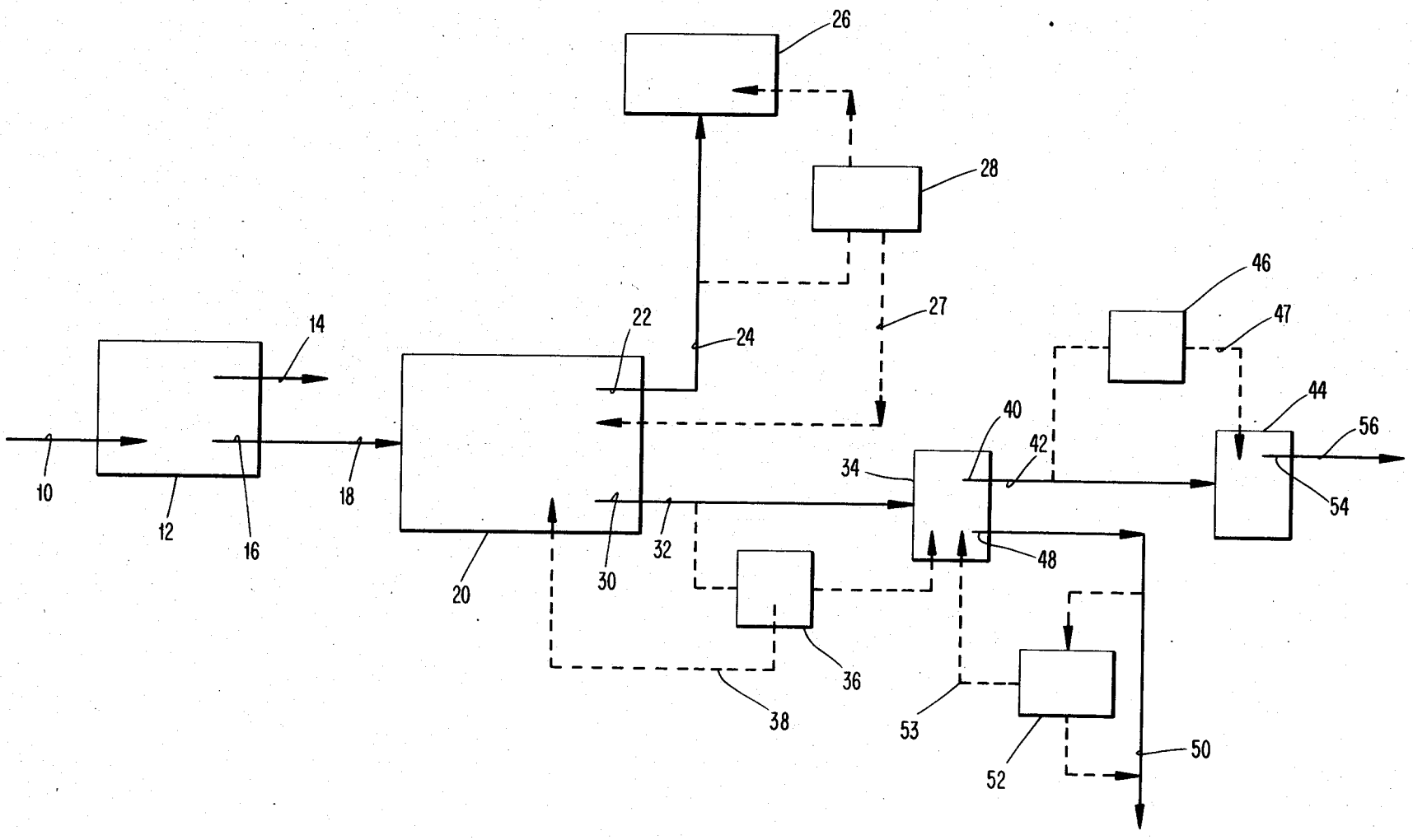
10
12
14
16
18
20
22
24
26
27
28
30
32
34
36
38
40
42
44
46
47
48
50
52
53
54
56

PROCESS OF PREPARING A DONOR SOLVENT FOR COAL LIQUEFACTION

BACKGROUND OF THE INVENTION

The present invention relates generally to coal liquefaction and, more particularly, to a process of preparing a donor solvent for coal liquefaction.

In the liquefaction of coal, it is desirable to use a donor solvent that is an efficient hydrogen transfer agent to hydrogenate at least partially the coal being liquefied. The donor solvent helps to saturate the various hydrocarbon compounds being formed during the coal liquefaction. It is also highly desirable that the donor solvent be derived from the coal feedstock to render the donor solvent more compatible with the coal feedstock and the various by-products of the coal liquefaction.

SUMMARY OF THE INVENTION

Quite surprisingly, the inventor has discovered a process that effectively produces a donor solvent that can be successfully used in the liquefaction of coal. More specifically, the present invention is directed to a process of preparing a donor solvent for coal liquefaction. The claimed process comprises the steps of: (a) distilling liquefied coal to separate the coal into a fraction having a boiling point less than about 350° F. and a residue having a boiling point greater than about 350° F.; (b) deasphalting the residue from the distillation in a first solvent capable of substantially extracting from the residue a first oil comprising lower molecular weight compounds and saturated compounds; and (c) deasphalting the residue from the first deasphalting step in a second solvent capable of substantially extracting from the residue a second oil comprising concentrated aromatic and heterocyclic compounds and leaving in the residue asphaltenes and ash. The second oil can be directly used as a donor solvent for the liquefaction of coal or it can first be partially hydrogenated.

The present process produces a donor solvent of maximum activity for use in liquefying coal or in hydrorefining of liquids derived from coal. Moreover, this donor solvent is advantageously generated internally from the refining of liquified coal to allow for its recycle to the liquefaction process.

The process of the present invention results in a donor solvent that contains higher concentrations of higher molecular weight aromatic compounds, particularly polycyclic aromatic compounds, and heterocyclic compounds, particularly nitrogen heterocyclic compounds, than are contained in a donor solvent that is derived merely by distillation. The donor solvent of the present invention, containing these aromatic compounds and heterocyclic compounds, acts as an efficient hydrogen transfer agent.

By maximizing the concentration of the aromatic compounds and the heterocyclic compounds, particularly polycyclic aromatic and nitrogen heterocyclic compounds, the process of the present invention yields a donor solvent that can be effectively recycled to the point at which the coal is initially undergoing liquefaction. Subsequently, during the coal liquefaction, the donor solvent of the present invention aids in the hydrogenation of the liquefied coal.

These advantages, goals, and features of the present invention will be made more apparent from the following description of the preferred embodiments and may be realized and obtained by means of the instrumentalities and combinations particularly pointed out in the appended claims.

BRIEF DESCRIPTION OF THE DRAWINGS

The accompanying drawing, which is incorporated in and constitutes a part of the specification, illustrates an embodiment of the invention and, together with the following description, serves to explain the principles of the invention.

The single FIGURE is a schematic diagram of the present invention.

DETAILED DESCRIPTION OF THE INVENTION

The present invention provides a process of preparing a donor solvent for use in coal liquefaction. In accordance with the invention, liquefied coal is distilled to separate the coal into a fraction having a boiling point less than about 350° F. and a residue having a boiling point greater than about 350° F. The residue from the distillation is then deasphalted in a first solvent capable of substantially extracting from the residue a first oil comprising lower molecular weight compounds and saturated compounds. The residue from the first deasphalting step is then deasphalted in a second solvent capable of substantially extracting from the residue a second oil comprising concentrated aromatic and heterocyclic compounds and leaving in the residue asphaltenes and ash. The second oil extracted in the second deasphalting step can be used directly as a donor solvent or it can first be partially hydrogenated.

This invention will now be described in connection with various embodiments of the invention without the invention being limited to any of the particular embodiments.

In the first step of the present invention, liquefied coal is distilled to separate the coal into a fraction having a boiling point less than about 350° F. and a residue having a boiling point greater than about 350° F. As shown schematically in the FIGURE, liquefied coal 10 is distilled in a distillation apparatus 12 to separate the coal into a fraction 14 having a boiling point less than about 350° F. and a first residue 16 having a boiling point greater than about 350° F. The fraction 14 is removed from the distillation apparatus 12 and can be collected for use in other processes, if desired. Various distillation apparatus known in the art can be used to effectuate the distillation of the liquefied coal.

In accordance with the second step of the present invention, the residue from the distillation is deasphalted in a first solvent capable of substantially extracting from the residue a first oil comprising lower molecular weight compounds and saturated compounds. As used herein, the term lower molecular weight compounds indicates that the compounds in the first oil have a lower molecular weight on average than the compounds that remain in the residue after the first deasphalting step. The term saturated compounds refers to compounds that have a relatively higher hydrogen to carbon ratio on average than the compounds that remain in the residue after the first deasphalting step. Examples of such saturated compounds include straight chain paraffins. The residue after the first deasphalting step contains more aromatic and heterocyclic compounds, along with asphaltenes and ash, than are present in the first oil.

The nitrogen content of the first oil is relatively lower than the nitrogen content in the residue of the distillation step and, hence, does not impair the catalyses used in the refining of the first oil. The first oil also preferably has a relatively lower concentration of polyaromatic compounds in comparison to the concentration in the second oil so as to render the first oil more suitable for refining.

In the schematic diagram shown in the FIGURE, the first residue 16 from the distillation apparatus 12 is led through a conduit 18 to a deasphalting apparatus 20. The first residue is then deasphalted in a first solvent to extract from the first residue 16 a first oil 22 and form a second residue 30.

The first solvent used in the deasphalting apparatus 20 is selected so as to substantially extracted from the residue 16 a first oil comprising lower molecular weight compounds and saturated compounds. Suitable first solvents include saturated hydrocarbons having 3–7 carbon atoms, such as aliphatic saturated hydrocarbons having 3–7 carbon atoms and cyclic saturated hydrocarbon having 3–7 carbon atoms. The aliphatic saturated hydrocarbon is preferably selected from propane, butane, pentane, hexane, and heptane. The cyclic saturated hydrocarbon is preferably cyclopropane, cyclobutane, cyclopentane, cyclohexane, or cycloheptane.

As schematically shown in the FIGURE, the first oil 22 can be removed from the deasphalting apparatus 20 through a conduit 24 and fed into a refining apparatus 26 to refine it by various processes known in the art. Prior to transporting the first oil 22 to the refining apparatus 26, the first oil can be passed through a solvent recovery apparatus 28 to recover excess first solvent present in the first oil. The recovered first solvent is recycled to the deasphalting apparatus 20 though a conduit 27. Various refining apparatus and solvent recovery apparatus known in the art can be used to refine and recover the solvent present in the first oil.

The temperature in the deasphalting apparatus 20 during the deasphalting of the residue 16 is preferably in the range of from about the critical temperature of the first solvent to about 100° F. below the critical temperature of the first solvent. Most preferably, the temperature in the deasphalting apparatus 20 is in the range of about 10° F. to about 60° F. below the critical temperature of the first solvent.

The pressure in the deasphalting apparatus 20 during the first deasphalting step is preferably maintained at about 50 lbs. above the vapor pressure of the mixture of the residue, the first solvent, and the first oil present in the deasphalting apparatus 20. Of course, the proper temperature and pressure would be readily selected by one skilled in the art depending upon, in part, the composition of the mixture.

The ratio of the first solvent to the first residue in the first deasphalting step is preferably maintained within the range of about 4:1 to about 13:1. Without being bound by theory, it is believed that when the ratio of the first solvent to the first residue is below about 4:1, not much separation occurs. Similarly, when this ratio is above about 13:1, the first deasphalting step is believed not to be very economical to perform.

In accordance with the present invention, in a third step the residue from the first deasphalting step is deasphalted in a second solvent capable of substantially extracting from the residue a second oil comprising concentrated aromatic and heterocyclic compounds and leaving in the residue asphaltenes and ash. The second oil has a relatively higher concentration of polyaromatic compounds and nitrogen containing compounds than the first oil. The second oil also has a lower hydrogen to carbon ratio than that contained in the first oil.

As shown schematically in the FIGURE, the second residue 30 from the first deasphalting apparatus 20 is fed through a conduit 32 to a second deasphalting apparatus 34. In the second deasphalting apparatus 34, the second residue 30 undergoes a second deasphalting in the second solvent to substantially extract from the residue a second oil 40 comprising concentrated aromatic and heterocyclic compounds leaving asphaltenes and ash 48 in the second residue 30. Various deasphalting apparatus known in the art can be used as the second deasphalting apparatus 34. The apparatus can be constructed so that the first 20 and second deasphalting apparatus 34 are the same.

Prior to entering the second deasphalting apparatus 34, the second residue 30 from the first deasphalting apparatus 20 can be passed through a first solvent recovery apparatus 36 to recover excess solvent that is present in the second residue 30. The recovered first solvent then is recycled to the deasphalting apparatus 20 through a conduct 38. Various solvent recovery apparatus known in the art can be used to effectuate this solvent recovery.

The second solvent used in the second deasphalting step is selected to substantially extract from the residue of the first deasphalting step a second oil comprising concentrated aromatic and heterocyclic compounds so as to leave in the residue asphaltenes and ash. The second solvent is preferably selected to have a relative high density so that the material extracted by the second solvent also has a relatively high density. As a result of such a selection, the heavier components of the residue of the first deasphalting step are left in the residue of the second deasphalting step.

Suitable second solvents include saturated hydrocarbons having 5–7 carbon atoms and aromatic compounds. Preferred saturated hydrocarbons are aliphatic saturated hydrocarbons having 5–7 carbon atoms and cyclic saturated hydrocarbons having 5–7 carbon atoms. The aliphatic saturated hydrocarbon is preferably selected from pentane, hexane, and heptane. The cyclic saturated hydrocarbon is preferably selected from cyclopentane, cyclohexane, and cycloheptane. The preferred aromatic compounds for use as the second solvent are benzene, xylene, and toluene.

The temperature in the second deasphalting apparatus 34 during the deasphalting of the residue 30 is preferably in the range of about the critical temperature of the second solvent to about 100° F. below the critical temperature of the second solvent. Most preferably, the temperature in the deasphalting apparatus 34 is selected to be within the range of about 10° F. to about 60° F. below the critical temperature of the second solvent.

The pressure in the second deasphalting apparatus 34 during the second deasphalting step is selected to be about 50 lbs. above the vapor pressure of the mixture of the residue, the second solvent, and the second oil present in the second deasphalting apparatus. The ratio of the second solvent to the second residue is preferably selected to be within the range of about 4:1 to about 13:1.

The second oil produced by the second deasphalting step is similar in hydrogen to carbon ratio and nitrogen content to those found in the residue of the distillation step, but the second oil has a lower asphaltene and ash content. This lower asphaltene and ash content renders the second oil suitable for recycling back into the coal liquifaction step as a donor solvent.

In accordance with the present invention, the second oil extracted in the second deasphalting step is preferably partially hydrogenated to form a donor solvent for the liquifaction of coal. In this preferred embodiment, as shown schematically in the FIGURE, the second oil 40 extracted in the second deasphalting apparatus 34 is fed through a conduit 42 into a hydrogenation apparatus 44 to form a donor solvent 54 especially suitable for the liquefaction of coal. Various hydrogenation apparatus known in the art can be effectively used to partially hydrogenate the second oil 40.

Prior to passing into the hydrogenation apparatus 44 or before being recycled to the coal liquefaction step, the second oil 40 is preferably passed through a solvent recovery apparatus 46, which is similar to the solvent recovery apparatus 28 and 36, to recover excess second solvent present in the second oil 40. The recovered excess second solvent is recycled to the second deasphalting apparatus 34 through a conduit 47.

The asphaltenes and ash 48 are led from the second deasphalting apparatus 34 through a conduit 50 to be used as fuel or in a gasification process. The asphaltenes and ash, after leaving the second deasphalting apparatus 34, can be first passed through a solvent recovery apparatus 52 to recover excess second solvent present in the asphaltenes and ash. The recovered second solvent is recycled to the second deasphalting apparatus 34 through a conduit 37.

The donor solvent 54 can then be fed through a conduit 56 to the coal liquefaction step. Although the composition of the donor solvent depends, in part, upon the composition of the liquefied coal and the various process parameters, a typical donor solvent resulting from the present invention has less asphaltene and ash content than the distillation residue. The typical donor solvent also has a hydrogen to carbon ratio and a nitrogen content similar to that of the distillation residue.

The following example further illustrates the process of the present invention. It is to be understood that the example is considered to be exemplary, and does not limit the scope of the invention.

EXAMPLE

A bench scale test of Wilsonville coal liquid residue was performed following the procedures of the present invention. The Wilsonville liquefied coal was distilled to separate the coal into a fraction having a boiling point less than about 350° F. and a residue having a boiling point greater than about 350° F. The residue from the distillation had an analysis of 83.14 percent carbon, 5.71 percent hydrogen, 1.30 percent nitrogen, 3.47 percent sulfur and oxygen, and 6.38 percent ash. The hydrogen to carbon ratio was 0.824 in the liquified coal feedstock.

The residue from the distillation was deasphalted in a first solvent of normal heptane to extract from the residue a first oil. The ratio of first solvent to residue in the first deasphalting step was 8:1. The temperature during the first deasphalting step was 500° F. and a pressure of 400 psig was maintained. The first deasphalting step produced a yield of 28.5 percent first oil that had a composition of 89.28 percent carbon, 7.54 percent hydrogen, 0.31 percent nitrogen, 2.84 percent sulfur and oxygen, and 0.03 percent ash. The hydrogen to carbon ratio in the first oil was 1.013.

Consequently, the first oil had a greater hydrogen to carbon ratio (1.013) than the hydrogen to carbon ratio in the distillation residue (0.824). Likewise, the first oil had a lower nitrogen content (0.31 percent) compared to the nitrogen content (1.30 percent) in the distillation residue.

The residue from the first deasphalting step was deasphalted in a second deasphalting step at a temperature of 540° F. and a pressure of 400 psig to extract from the residue a second oil. In the second deasphalting step, toluene was used as the second solvent in a ratio of second solvent to residue of 8:1. The second deasphalting step resulted in a yield of 42.5 percent of second oil.

The second oil produced by the second deasphalting step had an analysis of 86.82 percent carbon, 6.33 percent hydrogen, 1.27 percent nitrogen, negligible percent sulfur and oxygen, and 0.03 ash. The hydrogen to carbon ratio in the second oil was 0.875. The second deasphalting step also produced a yield of 29.0 percent asphaltenes and ash.

The second oil produced from the second deasphalting step was similar in hydrogen to carbon ratio and nitrogen content to the original coal distillation residue, but the second oil had significantly less ash (0.03 percent) than the ash content (6.38 percent) in the original distillation residue. Accordingly, it was found that the second oil produced by the second deasphalting step was suitable for recycle to the coal liquefaction step because of this low ash content.

It will be apparent to those skilled in the art that various modifications and variations could be made in the present invention without departing from the scope and content of the invention.

What is claimed is:

1. A process for preparing a hydrogen donor solvent having a high concentration of higher molecular weight polycyclic aromatic and heterocyclclic compounds suitable for use in coal liquefaction comprising the steps of:

(a) distilling liquefied coal to separate the coal into a fraction having a boiling point less than about 350° F. and a residue having a boiling point greater than about 350° F.;

(b) deasphalting the residue from the distillation in a first solvent capable of substantially extracting from the residue a high hydrogen to carbon ratio first oil comprising lower molecular weight compounds and saturated compounds; and (c) deasphalting the residue from the first deasphalting step in a second solvent capable of substantially extracting from the residue said donor solvent comprising concentrated aromatic and heterocyclic compounds and leaving in the residue asphaltenes and ash.

2. The process of claim 1, wherein the first solvent is a saturated hydrocarbon having 3 to 7 carbon atoms.

3. The process of claim 2, wherein the saturated hydrocarbon is selected from the group consisting of aliphatic saturated hydrocarbons and cyclic saturated hydrocarbons.

4. The process of claim 1, wherein the first solvent is selected from the group consisting of propane, butane, pentane, hexane, and heptane.

5. The process of claim 1, wherein the second solvent is selected from the group consisting of saturated hydrocarbons having 5 to 7 carbon atoms and aromatic compounds.

6. The process of claim 5, wherein the saturated hydrocarbon is selected from the group consisting of aliphatic saturated hydrocarbons and cyclic saturated hydrocarbons.

7. The process of claim 5, wherein the aromatic compound is selected from the group consisting of benzene, xylene, and toluene.

8. The process of claim 1, wherein the second solvent is selected from the group consisting of pentane, hexane, and heptane.

9. The process of claim 1, further comprising the step of refining the first oil from the first deasphalting step.

10. The process of claim 1, wherein the liquefied coal distilled in step (a) has been liquefied in the presence of said donor solvent.

11. The process of claim 1, wherein the temperature in step (b) is in the range of about the critical temperature of the first solvent to about 100° F. below the critical temperature of the first solvent.

12. The process of claim 1, wherein the temperature in step (b) is within the range of about 10° F. to about 60° F. below the critical temperature of the first solvent.

13. The process of claim 1, wherein the pressure in step (b) is 50 lbs. above the vapor pressure of the mixture of the residue, the first solvent, and the first oil present in step (b).

14. The process of claim 1, wherein the ratio of the first solvent to the distillation residue is in the range of about 4:1 to about 13:1.

15. The process of claim 1, wherein the temperature in step (c) is between the range of about the critical temperature of the second solvent to about 100° F. below the critical temperature of the second solvent.

16. The process of claim 1, wherein the temperature in step (c) is about 10° F. to about 60° F. below the critical temperature of the second solvent.

17. The process of claim 1, wherein the pressure in step (c) is about 50 lbs. above the vapor pressure of the mixture of the residue, the second solvent, and said donor solvent.

18. The process of claim 1, wherein the ratio of the second solvent to the residue is in the range of about 4:1 to about 13:1.

19. The process of claim 1, further comprising the step of partially hydrogenating said donor solvent prior to use as a donor solvent for the liquefaction of coal.

* * * * *